US009205972B2

(12) United States Patent
Alexopoulos et al.

(10) Patent No.: US 9,205,972 B2
(45) Date of Patent: Dec. 8, 2015

(54) METHODS AND SYSTEMS FOR DISPENSING

(71) Applicant: Intralot S.A.—Integrated Lottery Systems and Services, Athens (GR)

(72) Inventors: Ilias Alexopoulos, Athens (GR); Apostolos Dalas, Athens (GR); Georgios Dimitrakopoulos, Athens (GR)

(73) Assignee: Intralot S.A.—Integrated Lottery Systems and Services, Athens (GR)

( * ) Notice: Subject to any disclaimer, the term of this patent is extended or adjusted under 35 U.S.C. 154(b) by 230 days.

(21) Appl. No.: 13/752,231

(22) Filed: Jan. 28, 2013

(65) Prior Publication Data

US 2013/0193155 A1 Aug. 1, 2013

Related U.S. Application Data

(60) Provisional application No. 61/591,031, filed on Jan. 26, 2012.

(51) Int. Cl.
*G07B 3/00* (2006.01)
*B65D 83/12* (2006.01)
(Continued)

(52) U.S. Cl.
CPC ..... *B65D 83/12* (2013.01); *B65D 90/48* (2013.01); *B65H 35/04* (2013.01); *B65H 35/10* (2013.01); *G07B 3/00* (2013.01); *B65H 2511/11* (2013.01);
(Continued)

(58) Field of Classification Search
CPC ..... G07B 3/00; G07B 3/02; G07B 3/04; B65D 83/12; B65D 90/48; B65H 35/04
See application file for complete search history.

(56) References Cited

U.S. PATENT DOCUMENTS 3,006,567 A 10/1961 Collins
3,685,690 A 8/1972 Karecki et al.
(Continued)

FOREIGN PATENT DOCUMENTS

CN 2432196 Y 5/2001
CN 1490236 A 4/2004
(Continued)

OTHER PUBLICATIONS

Bartos, "Measurement Specialities—Absolute Angular Positioning Utilizing Magnetoresistive Sensors", pp. 1-74 © Copyright 2008 Measurement Specialities, Inc.
(Continued)

*Primary Examiner* — Timothy Waggoner
(74) *Attorney, Agent, or Firm* — Greenberg Traurig, LLP

(57) ABSTRACT

The instant invention provides an exemplary method for dispensing that at least includes: initiating a movement of a dispensing object along a dispensing passage of a dispensing device; determining, by a displacement sensor, a magnitude of a displacement of the dispensing object along the dispensing passage based on remotely measuring, by the displacement sensor, a characteristic associated with the dispensing object during the movement of the dispensing object along the dispensing passage; generating an indication by the displacement sensor when the magnitude of the displacement is equal to or exceeds a pre-determined distance value; separating, based on the indication, a portion from the dispensing object to form a remaining portion of the dispensing object and a separated portion of the dispensing object; and dispensing the separated portion of the dispensing object from the dispensing device.

14 Claims, 7 Drawing Sheets

(51) Int. Cl.
*B65D 90/48* (2006.01)
*B65H 35/04* (2006.01)
*B65H 35/10* (2006.01)

(52) U.S. Cl.
CPC ..... *B65H 2553/22* (2013.01); *B65H 2701/1936* (2013.01)

(56) References Cited

U.S. PATENT DOCUMENTS

| | | | | |
|---|---|---|---|---|
| 3,894,669 | A | 7/1975 | Wescoat | |
| 4,094,451 | A | 6/1978 | Wescoat | |
| 4,688,708 | A | 8/1987 | Irvine et al. | |
| 4,716,799 | A * | 1/1988 | Hartmann | 83/42 |
| 4,945,213 | A * | 7/1990 | Didiergeorge | 235/31 T |
| 4,954,840 | A * | 9/1990 | Maud et al. | 235/378 |
| 4,982,337 | A | 1/1991 | Burr et al. | |
| 5,100,022 | A | 3/1992 | Fukudome et al. | |
| 5,104,111 | A | 4/1992 | Matsuda | |
| 5,836,498 | A | 11/1998 | Turek | |
| 5,950,898 | A | 9/1999 | Menna | |
| 6,168,151 | B1 | 1/2001 | Tsuchida | |
| 6,669,071 | B1 | 12/2003 | Menna | |
| 6,712,253 | B2 * | 3/2004 | Hargrave et al. | 225/100 |
| 6,726,077 | B2 | 4/2004 | Roberts et al. | |
| 6,886,728 | B2 | 5/2005 | Roberts et al. | |
| 6,932,258 | B1 | 8/2005 | Roberts et al. | |
| 7,032,793 | B2 | 4/2006 | Roberts et al. | |
| 7,234,610 | B2 | 6/2007 | Skarda et al. | |
| 7,364,058 | B2 * | 4/2008 | Bartolone et al. | 225/106 |
| 7,383,099 | B2 | 6/2008 | Pollard et al. | |
| 7,562,798 | B2 | 7/2009 | Bartolone et al. | |
| 7,665,394 | B2 | 2/2010 | Roberts et al. | |
| 7,942,290 | B2 * | 5/2011 | Halliburton et al. | 221/30 |
| 8,127,973 | B2 | 3/2012 | Mirkovic et al. | |
| 8,192,268 | B1 | 6/2012 | Karpe | |
| 8,210,921 | B1 | 7/2012 | Karpe | |
| 8,387,864 | B1 | 3/2013 | Blackson | |
| 2002/0117528 | A1 | 8/2002 | Turek | |
| 2002/0179668 | A1 | 12/2002 | Hargrave et al. | |
| 2003/0120381 | A1 | 6/2003 | Perin et al. | |
| 2004/0000572 | A1 | 1/2004 | Engelhardt et al. | |
| 2004/0200874 | A1 | 10/2004 | Menna | |
| 2005/0061825 | A1 | 3/2005 | Willoughby et al. | |
| 2006/0175344 | A1 | 8/2006 | Skarda et al. | |
| 2006/0293783 | A1 | 12/2006 | Hand et al. | |
| 2007/0017978 | A1 | 1/2007 | Ho | |
| 2009/0152292 | A1 | 6/2009 | Mirkovic et al. | |
| 2010/0286817 | A1 | 11/2010 | Goeking et al. | |
| 2012/0109365 | A1 | 5/2012 | Dalas et al. | |
| 2012/0271455 | A1 | 10/2012 | Dalas et al. | |

FOREIGN PATENT DOCUMENTS

| | | | |
|---|---|---|---|
| CN | 101577016 | A | 11/2009 |
| EP | 2 447 917 | A1 | 5/2012 |
| JP | H11259695 | A | 9/1999 |
| TW | I249143 | B | 2/2006 |
| TW | 200933532 | A | 8/2009 |

OTHER PUBLICATIONS

European Search Report from European Patent Appln. No. 10191116 dated Apr. 15, 2011.
International Search Report and Written Opinion issued in connection with International Appln. No. PCT/IB2013/000482 dated Aug. 5, 2013.
Search Report from Taiwan Patent Application No. 099167610 dated May 26, 2015.
Search Report issued in connection with Chinese Patent Application No. 201010552458.X on Apr. 16, 2015.

* cited by examiner

METHODS AND SYSTEMS FOR DISPENSING

RELATED APPLICATIONS

This application claims the priority of U.S. provisional application Ser. No. 61/591,031, entitled "METHODS AND SYSTEMS FOR DISPENSING," filed on Jan. 26, 2012, which is incorporated herein by reference in its entirety for all purposes.

FIELD OF THE INVENTION

The present invention relates to methods and systems for dispensing objects such as, but not limiting to, tickets (e.g., lottery tickets), paper products, and, in general, to any item and/or item in a packaging which one of ordinary skills recognizes to be suitable for a machine-controlled dispensation.

BACKGROUND OF THE INVENTION

The present invention relates to methods and systems for dispensing objects using a machine-controlled dispensation.

SUMMARY OF THE INVENTION

In some embodiments, the instant invention provides an exemplary method for dispensing that at least includes: a) initiating a movement of a dispensing object along a dispensing passage of a dispensing device, wherein the movement is initiated from a pre-set starting position; b) determining, by at least one displacement sensor, a magnitude of a displacement of the dispensing object along the dispensing passage based on remotely measuring, by the at least one displacement sensor, at least one characteristic associated with the dispensing object during the movement of the dispensing object along the dispensing passage; c) generating at least one first indication by the at least one displacement sensor when the magnitude of the displacement is equal to or exceeds a pre-determined distance value; d) separating, based on the at least one first indication, a portion from the dispensing object to form a remaining portion of the dispensing object and a separated portion of the dispensing object, e) moving the remaining portion of the dispensing object back to the pre-set starting position; and f) dispensing the separated portion of the dispensing object from the dispensing device.

In some embodiments, the exemplary method of the instant invention further includes: generating, by at least one exit sensor positioned next to an exit end of the dispensing passage of the dispensing device, at least one second indication when the dispensing object reaches the at least one exit sensor, wherein the determining, by the at least one displacement sensor, of the magnitude of the displacement of the dispensing object along the dispensing passage begins after the at least one displacement sensor receives the at least one second indication.

In some embodiments, the at least one characteristic associated with the dispensing object is determined based, at least in part, on: registering, by the at least one displacement sensor, at least one angle of displacement of at least one magnet attached to an idle roller which is rotated by a surface of the dispensing object during the movement of the dispensing object along the dispensing passage.

In some embodiments, the at least one characteristic associated with the dispensing object is determined based, at least in part, on at least one light characteristic registered by the at least one displacement sensor after at least one light beam is directed at a surface of the dispensing object during the movement of the dispensing object along the dispensing passage.

In some embodiments, the exemplary method of the instant invention further includes: maintaining, by at least one tension mechanism, the dispensing object in a state of tension and at a pre-determined separation distance away from the at least one displacement sensor. In some embodiments, the at least one tension mechanism comprises at least one active roller.

In some embodiments, the at least one tension mechanism further includes a plurality of active rollers, wherein the plurality of active rollers comprises at least one feeding roller rotating at a first speed and at least one exit roller rotating at a second speed, and wherein the first and the second speeds are different.

In some embodiments, the dispensing object is a strip of lottery tickets and the separated portion of the dispensing object is a lottery ticket.

In some embodiments, the instant invention provides a dispensing device that at least includes: a) at least one active feed mechanism to initiate a movement of a dispensing object along a dispensing passage of the dispensing device, where the movement is initiated from a pre-set starting position; b) at least one displacement sensor, i) where the at least one displacement sensor determines a magnitude of a displacement of the dispensing object along the dispensing passage based on remotely measuring at least one characteristic associated with the dispensing object during the movement of the dispensing object along the dispensing passage, and ii) where the at least one displacement sensor generates at least one first indication when the magnitude of the displacement is equal to or exceeds a pre-determined distance value; c) at least one separation mechanism, where the at least one separation mechanism separates, based on the at least one first indication, a portion from the dispensing object to form a remaining portion of the dispensing object and a separated portion of the dispensing object, d) where the at least one active feed mechanism moves the remaining portion of the dispensing object back to the pre-set starting position; and e) where the at least one active feed mechanism dispenses the separated portion of the dispensing object from the dispensing device.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

Figure 1:
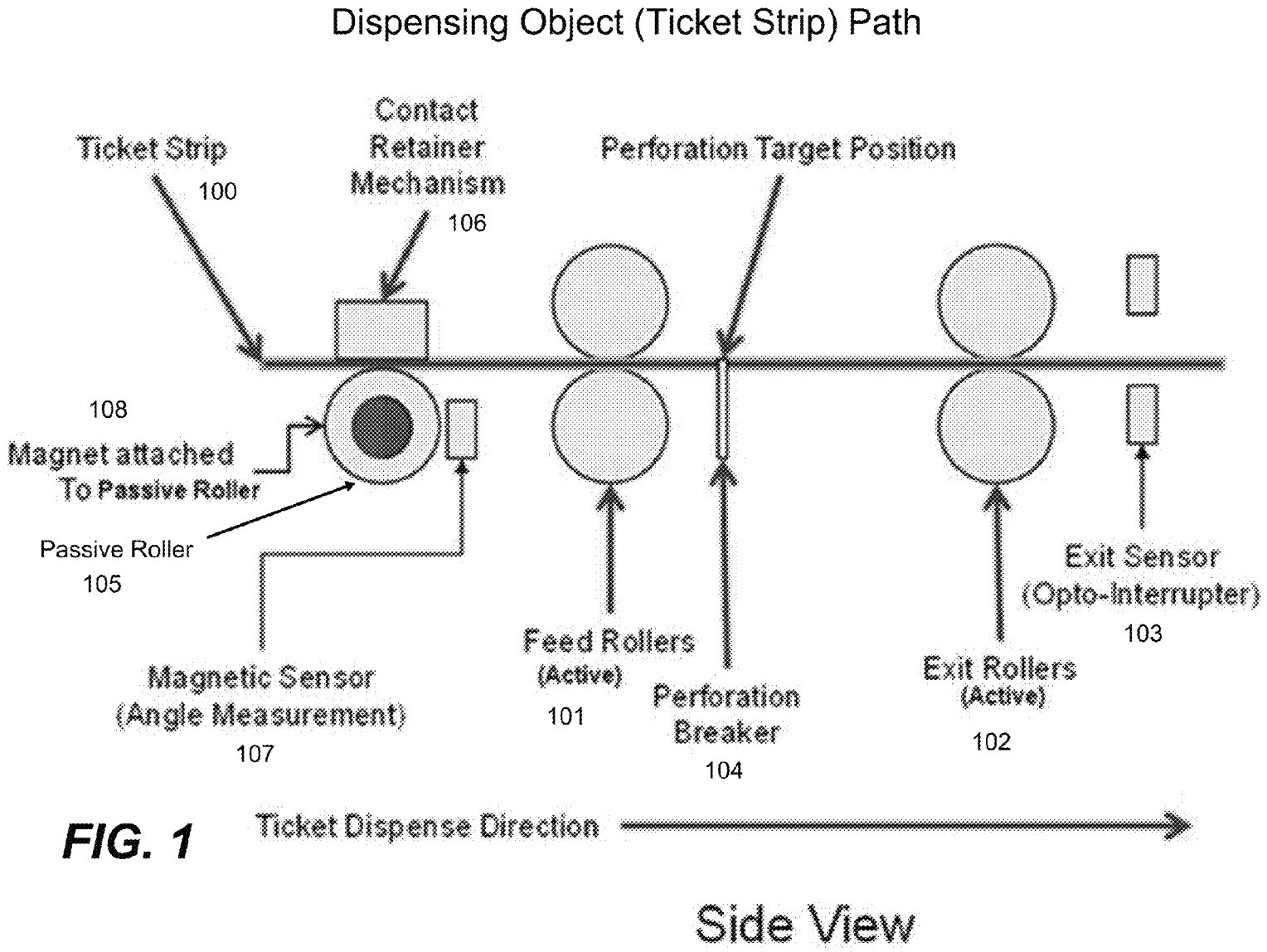
FIG. 1 illustrates inventive aspects of some embodiments of the instant invention.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed invention. In addition, any measurements, specifications and the like shown in the figures are intended to be illustrative, and not restrictive.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Therefore, specific structural and functional details disclosed herein are not to be interpreted as limiting, but merely as a representative basis for teaching one skilled in the art to variously employ the present invention.

Throughout the description, the following terms take the meanings explicitly associated herein, unless the context clearly dictates otherwise. The phrases "In some embodiments" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

In some embodiments, the instant invention allows for dispensing tickets that can be packaged in strips of tickets connected over a perforated line. The tickets are dispensed by separating along the perforated line. Each ticket is separated from the strip by positioning the perforated line over the separation mechanism. In some embodiments, the positioning of each ticket for separating by the separation mechanism is achieved by measuring a distance that the ticket travels. In some embodiments, the ticket travel distance is measured by utilizing a passive roller being in contact with the strip of tickets. In some embodiments, the passive roller is operatively connected to at least one magnet and at least one magnetic sensor which measures a magnetic angle that tracks the passive roller's rotation. In some embodiments, the magnetic sensor can measure the distance travelled by the strip of tickets by measuring the magnetic rotational field of the magnet connected to the passive roller to determine the precise rotation of the free-running passive roller which is in-touch with a ticket to be dispensed. In some embodiments, the instant invention can utilize magnets such as, but not limiting to, disk or ring magnets. In some embodiments, the instant invention can determine the travelled distance by having the passive roller be in passive contact with either the top or the bottom surface of the ticket. In some embodiments, the instant invention can utilize a plurality of passive rollers. In some embodiments, the tickets are moved/pulled in contact with the passive roller(s) by utilizing a gearbox arrangement driven by a motor.

In some embodiments, the instant invention can provide a dispensing system/device having at least four major sections: the sensor passive roller, the feed roller assembly driving the strip of tickets, the separating/bursting blade that cuts the perforation separating a ticket, and the exit assembly ejecting the separated ticket from the dispensing system/device.

In some embodiments, the instant invention can utilize one or more magnets and one or more Anisotropic magnetoresistance (AMR) sensor which can detect small angles of magnetic field rotation in a repeatable way. The exemplary AMR sensors that some embodiments of the instant invention can utilize are HMC1501 (Honeywell) and HMC1512 (Honeywell), and their principles of operations alone or in combination with hall effect sensors are incorporated by reference herein in theirs entirety for all purposes set forth. In some embodiments, the AMR sensors' angular measurement allow for a full 360 degrees rotational position sensing that is based on phase shift and a difference.

In some embodiments, the instant invention can utilize one or more magnets and one or more magnetoresistive sensors which can detect small angles of magnetic field rotation in a repeatable way. The exemplary magnetic sensors and their principles of operations are described in "Absolute Angular Positioning Utilizing Magnetoresistive Sensors," Measurement Specialties, Inc., which specific disclosures are incorporated by reference herein in theirs entirety for all purposes set forth.

In some embodiments, the instant invention can utilize magnetic Hall-Effect Sensors or a combination of AMR and Hall-Effect Sensors. In some embodiments, the instant invention can utilize one or more magnetic sensors not only as a precision measurement device but also as a motion detector to supplement its primary applications. In some embodiments, the magnetic sensors utilized by the instant invention measure the directional information.

In some embodiments, the instant invention can utilize a 2-pole drum or ring magnet, having a diameter of about 5-15 mm, on a shaft. In some embodiments, utilizing the 2-pole drum or ring magnet, the instant invention allows to determine absolute angular positioning. In some embodiments, the instant invention can utilize, but not limited to, 4-pole, multipole magnets, or any other suitable magnetic sensors.

In some embodiments, the instant invention can allows to determine the absolute angular positioning resolution with a precision of about 0.5 degrees rotation or less. In some embodiments, the instant invention can allows to determine the absolute angular positioning resolution with the precision of about 0.25 degrees rotation or less. In some embodiments, the instant invention can allows to determine the absolute angular positioning resolution with the precision of about 0.2 degrees rotation or less. In some embodiments, the instant invention can allows to determine the absolute angular positioning resolution with the precision of about 0.1 degrees rotation or less. In some embodiments, the instant invention can allows to determine the absolute angular positioning resolution with the precision of about 0.05 degrees rotation or less. In some embodiments, the instant invention can allows to determine the absolute angular positioning resolution with the precision of about 0.01 degrees rotation or less.

In some embodiments, the instant invention utilizes a mechanism to maintain the strip of dispensing tickets or other objects in a continuous contact with one or more passive rollers to which the magnetic sensors are operationally connected. In some embodiments, the instant invention utilizes a mechanical tension mechanism to maintain the continuous contact between the dispensing tickets (objects) and the passive roller. In some embodiments, the instant invention utilizes a mechanical pressure mechanism to maintain the continuous contact between the dispensing tickets (objects) and the passive roller. In some embodiments, the instant invention utilizes a series of passive rollers that are divided into a first group of one or more first type passive rollers that are operationally connected to one or more magnets and magnetic sensors and a second group of one or more second type passive rollers that maintain the continuous contact between the strip of dispensing tickets (objects) and the first group of one or more first type passive rollers and are positioned on the opposite side of the strip of dispensing tickets across the first group of one or more first type passive rollers.

In some embodiments, the instant invention utilizes measurements of direction and absolute angular positioning to determine the displacement of the dispensing object (e.g., ticket). In some embodiments, the instant invention can allow to position the dispensing objects (e.g., the strip of tickets) in a predetermined position with accuracy of about +1-1 mm (millimeters) over about 305 mm of the traveled distance. In some embodiments, the instant invention allows to avoid relying on matching speeds of motors, rotating the active rollers, to determined the distance traveled by pulled the strip of tickets. In some embodiments, the instant invention allows not to use the magnetic sensor information for controlling speeds of motors that are responsible for moving (pulling) along the dispensing objects.

EXAMPLE OF SAME EMBODIMENT OF THE INSTANT INVENTION

Example 1

In some embodiments, the instant invention utilizes an exemplary design, shown in FIG. 1. In some embodiments, the active moving parts of the shown dispensing device in FIG. 1 are a ticket path (100) and a ticket motion drive which are a feed roller assembly (101) and an exit roller assembly (102). In some embodiments, the feed roller assembly (101) can have two opposing rollers pressing each other. In some embodiments, a motor drives the bottom roller, while the top roller is turned due to friction from the ticket. In some embodiments, the exit roller assembly (102) can have a similar arrangement with another motor driving a bottom exit roller and a top exit roller being moved by friction. In some embodiments, after the exit roller assembly (102), there can be an exit sensor (103) which is utilized to detect a presence of the ticket and a proper dispensing after the ticket is separated by a perforation breaker (104). In some embodiments, the exit sensor (103) can could be, but not limited to, an opto (or photo)-interrupter sensor or another sensor with similar functionality.

In some embodiments, as shown in FIG. 1, the instant invention provides for a displacement measuring system that at least includes a passive free running roller (105), a pressure retainer mechanism (106) and a rotation measurement magnetic sensor (107) that is operatively connected to the passive roller (105), for example but not limited to, by having a magnet component (e.g., ring magnet) (108) of the magnetic sensor being attached to the passive roller.

In some embodiments, the operation of the above exemplary design can be as follows. Initially, the tickets are fed to the ticket path (100) by the feed rollers of the feed roller assembly (101). The tickets then enter the exit roller assembly (102) and the tickets are moving under the drive of both motors. The interruption of the exit sensor's (103) beam resets the distance measurement mechanism. In one example, the reset can be performed only once on the first ticket in the pack, if the accuracy and reproducibility of measurements of the displacement measuring sensor (107) is sufficient based on a particular application and/or the dispensing object (e.g., a sizable perforation area between two successive area demands lesser accuracy then the more narrow one). In some embodiments, a length of each ticket has been pre-programmed to the displacement measuring mechanism and thus the design moves the ticket forward until the perforation is over the separation blade (104). In some embodiments, after the separation, the next ticket is retracted by the feed rollers (101) to a preset position while the exit roller assembly (102) pushes the cut-off ticket out of the dispenser until the exit sensor (103) is unblocked.

Example 2

Displacement Measurement Magnetic Sensor Assembly

A typical practice is to attach an encoder (sensor) on a motor shaft. The motor typically has a gearbox that steps down velocity (e.g., for providing higher torque and better control). Thus, if the attached encoder has k-steps, the gearbox has a reduction ratio 1:n, and the active roller a perimeter of m (meter), then the resolution achieved is:

$$\text{resolution}=m/(k*n) \text{ in length units} \qquad \text{(equation 1).}$$

For example, for 12 pulses per revolution of the encoder, the gearbox of 1:30, and the active roller perimeter 2.62 inch, the resulting resolution is 0.0072 inch per an encoder pulse (or 7.2 mils (0.001=one thousandth of an inch or 1.0 mil)).

In some embodiments, the instant invention allows to attach the encoder to the passive roller of the displacement measurement sensor system (shown in FIG. 1) and to achieve a resolution (resolution=m/k) which is better than 0.218 inch per encoder pulse.

In some embodiments, the instant invention allows to achieve a resolution on the passive roller which may not need to utilize an encoder having a resolution (k*n) of 360 pulses per revolution.

In some embodiments, the instant invention allows to maintain a continuous contact between the dispensing objects (e.g., tickets) and the passive roller—i.e., to sufficiently track the dispensing objects, —by having the passive roller of the displacement measuring magnetic sensor assembly to display one or more of the following properties, but not limited to, sufficient frictional properties, an uniform perimeter, sufficiently low inertia and friction mounting to, in order to properly track the ticket motion. In some embodiments, there are one or more of the following characteristics, but not limited to, utilized by the instant invention:

1) Sufficiently low inertia and friction mounting: the passive roller of the displacement measuring magnetic sensor assembly mounting has to have a friction which is at least comparably at least equal or less to sufficiently maintain the contact with and track the dispensing objects (e.g., tickets);

2) Uniform perimeter: the passive roller of the displacement measuring magnetic sensor assembly has to be uniform to sufficiently maintain the contact with and track the dispensing objects (e.g., tickets) at all possible rotation angles to result in sufficiently correct measurements;

3) Sufficient frictional properties: the passive roller of the displacement measuring magnetic sensor assembly has to display sufficient frictional properties (e.g., selecting a rubber of certain properties that provide sufficient frictional properties to sufficiently maintain the contact with and track the dispensing objects (e.g., tickets)); and 4) Sufficient continuous Contact.

Example 3

Sufficient Continuous Contact—a Thinner Possible Dispensing Object

Figure 2:
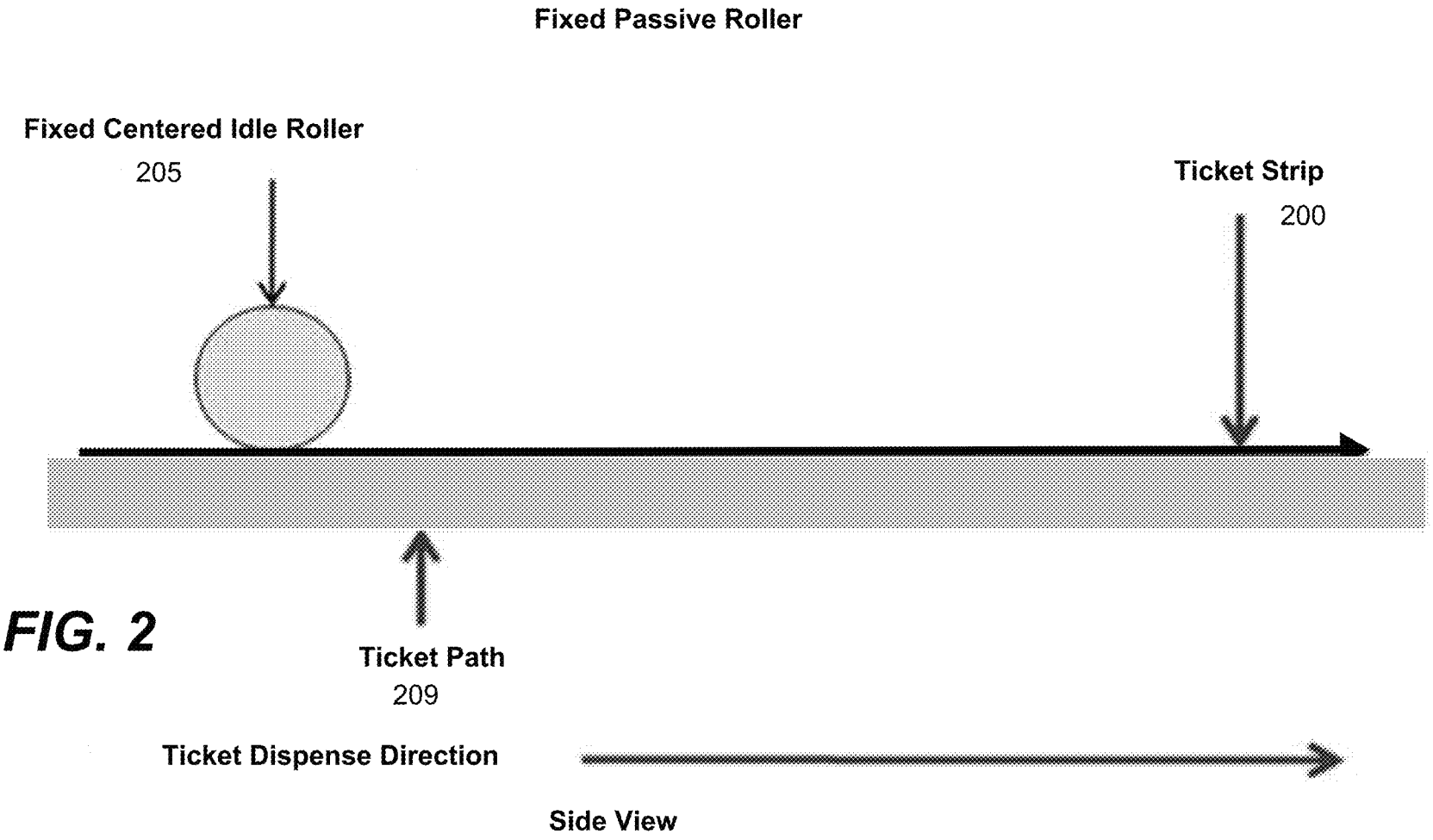
FIG. 2 illustrates another inventive aspects of some embodiments of the instant invention.

In some embodiments, the instant invention utilizes a passive (measuring) roller (205) of the displacement measuring magnetic sensor assembly that can be designed, but not limited to, as illustrated in FIG. 2. In some embodiments, the passive (measuring) roller (205) with a fixed center of rotation must have a sufficient diameter to sufficiently maintain the contact with and track a thinner possible dispensing object (e.g., tickets). In some embodiments, the displacement of the dispensing ticket/ticket strip (200) is computed by, but not limited to, the following formula:

$$S=S0+i/k*m \quad \text{(equation 2).}$$

Where, S is current displacement; S0 is previous displacement; i is sensor's counts on this step; k is sensor's resolution (counts/revolution); and m is roller's perimeter that equals $2\pi R$ where R the roller's radius.

In some embodiments, if there is a small gap between the passive roller's (205) radius and the ticket path (209) then the actual displacement of a thin ticket can be sufficiently closer to the theoretical value computed by equation (2). As the passive roller (205) and the ticket strip (200) are compressed together, the passive roller's (205) radius R is decreased and thus the calculation of the equation (2) includes a sufficiently small error which can be acceptable.

Example 4

Sufficient Continuous Contact—a Thicker Dispensing Object

Figure 3:
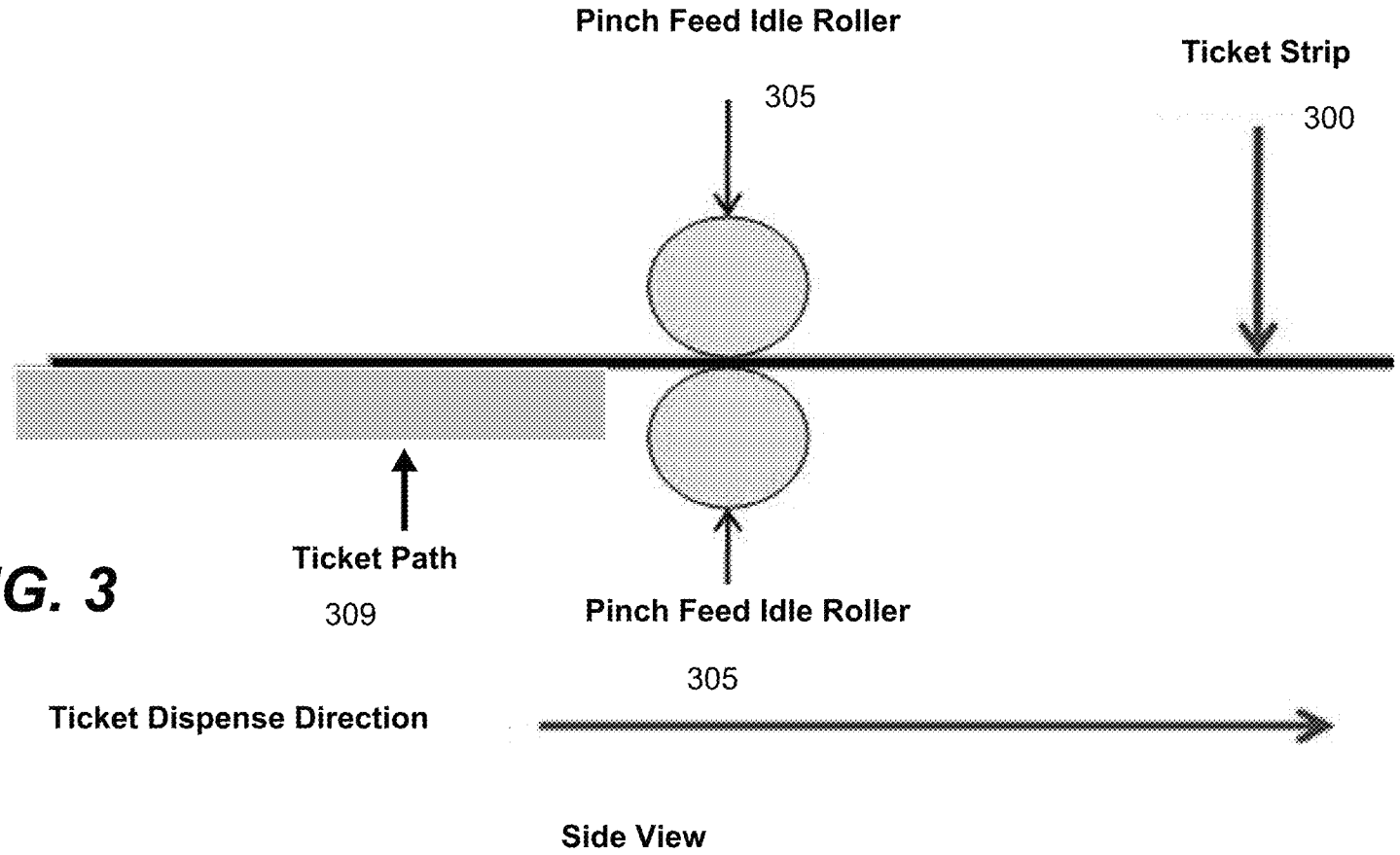
FIG. 3 illustrates yet another inventive aspects of some embodiments of the instant invention.

In some embodiments, the instant invention utilizes a passive (measuring) roller (305) (e.g., pinched feed idle roller) of the displacement measuring magnetic sensor assembly that can be designed, but not limited to, as illustrated in FIG. 3. In some embodiments, the passive (measuring) roller (305) with a fixed center of rotation must have a sufficient diameter to sufficiently maintain the contact with and track a thinner possible dispensing object (e.g., a strip of tickets) (300). In some embodiments, the instant invention allows to avoid an increase in errors to unacceptable level when a thicker dispensing object (e.g., a strip of tickets) is introduced since, otherwise, the active roller of the feed assembly would have to apply more force to the dispensing object to counteract a greater resistance force exhibited by the idle roller of the feed assembly. In some embodiments, the instant invention allows to avoid the additional increase in errors to unacceptable level when there can be due to a non-uniformity of the surface of the active feed roller. Examples of typical errors that some embodiments of the instant invention can remedy are provided in Table 1. As shown in FIG. 3, when a strip of tickets (300) or another dispensing object passes through the pinch feed (305) or exit rollers and as the pinch rollers are being compressed, the actual diameter performed is given by a pinch radius. In Table 1, for demonstrating errors, a pinch distance is assumed as given between the feed rollers. As, for example, a particular strip of tickets passes through the feed rollers, the pinch radius varies. Table 1 provides determination for 3 different ticket thickness cases (minimum, maximum, typical) and demonstrates that there could be sufficiently significant error in calculating the ticket's displacement that the instant invention allows to remedy.

TABLE 1

| | Min | Max | Typical |
|---|---|---|---|
| Ticket Thickness (mm) | 0.24 | 0.32 | 0.28 |
| R (mm) | 10.795 | 10.795 | 10.795 |
| Pinch (mm) | 10.555 | 10.475 | 10.515 |
| Perimeter (mm) | 66.31902 | 65.81637 | 66.06769 |
| Error/Rotation | 0 | −0.50265 | −0.25133 |
| Mean Error/Rotation (mm/rot) | −0.25133 | 0.251327 | 0 |
| Rotations for 12 in | 4.621212 | | |
| Error for 12 in (mm) | 0 | −2.32287 | −1.16144 |

In some embodiments, the instant invention allows to overcome the errors demonstrated in Table 1, by providing a mechanism minimizes or eliminates the thickness error factor of the dispensing objects (e.g., the strip of tickets).

In some embodiments, the provided mechanism at least include an independent passive roller of the displacement measuring assembly. In some embodiments, as shown in FIG. 1, the measurement passive roller is on the bottom side (although such design is not mandatory or limiting but exemplary) because, in some cases, the dispensing objects such as a strip of tickets can have a better friction surface on the bottom (e.g., absence of coating that reduces friction).

In some embodiments, the instant invention provides the displacement measuring sensor assembly (105-108) having the contact retainer mechanism (106) position on the opposite side from the passive roller. In some embodiments, the contact retainer mechanism can include, but not limited to, for example, one or more plastic rollers which are pressed against the measurement passive roller through a bias component, such as, but not limiting to, a spring, a spring acting sheet metal, or any other suitable mechanical configuration which performs the biasing task of pressing the contact retainer mechanism toward the passive roller.

In some embodiments, the measurement passive roller protrudes in the path of the dispensing object (e.g., ticket) so that the ticket has to pass over the measurement passive roller and sweep the roller along its way. In some embodiments, on the opposite side, the contact retainer mechanism (106) (e.g., roller(s)) presses over the ticket to the measurement passive roller in order to keep the continuous contact between the displacement measuring sensor assembly and the ticket.

In some embodiments, the instant invention allows the measurement radius to remained without being changed or pinched, avoiding errors presented in Table 1. In some embodiments, the instant invention allows to reduce or eliminate any roller or the surface irregularities by utilizing the retainer mechanism (106)—e.g., in the case of the thicker dispensing object, the roller(s) of the contact retainer mechanism (106) is/are compressed harder to the passive measurement roller (105) to continuously maintain sufficient contact with the measuring roller (105). In some embodiments, applying the instant invention can result in the feed (101) and/or exit drive (active) assembly (102) not being overstressed by the thicker dispensing objects (e.g., strip of tickets), resulting in a condition in which the dispensing object's thickness does not pose a substantially different mechanical behavior for the feed mechanisms (101 and 102).

In some embodiments, the measurement passive roller (e.g., the idle roller 105) needs to exhibit sufficiently low rotational friction and inertia to follow the displacement of the dispensing object (e.g., strip of tickets) with a sufficient precision.

In some embodiments, the instant invention can utilize one or more magnets and one or more magnetic sensors as past of the displacement measuring assembly to provide a contactless measurement of the passive roller's (e.g., the idle roller 105) rotation. In some embodiments, the instant invention can utilize other suitable method(s) and device(s) to accomplish the contactless measurement of the passive roller (e.g., utilizing an optical sensor to measure a perimeter of the rotation of the idle roller (105) after an instruction to start the measurement is received by the optical sensor). In some embodiments, for the contactless measurement, the instant invention can allow to utilize a standard encoder part (e.g., optic, magnetic, or other suitable sensor).

In some embodiments, one or more magnets are attached on the passive roller and one or more magnetic sensors are positioned in sufficiently close proximity to detect angular motion of the passive roller with magnet(s).

In some embodiments, in the case of utilizing the magnetic sensors as part of the measuring assembly, resolution of magnetic sensor(s) can be variable and programmable as the angle is provided by signal processing algorithms) and can be changed/adapted to particular dispensing objects and/or operations. In some embodiments, the instant invention provides the direction information and absolute angular positioning.

In some embodiments, the instant invention allows to minimize or eliminated an impact from any longitudinal forces applied on the dispensing object (e.g., strip of tickets) during the displacement measurement. For example, such longitudinal forces could be a result of dispensing object (e.g., strip of tickets) unfolding from a pack, motor rotational differences, jams, inertial forces, etc. In some embodiments, the instant invention allows to align the first dispensing object (e.g., strip of tickets) with an exit sensor (e.g., a sensor 103) for taking a reference and then all subsequent dispenses can ignore the exit sensor readings for the reference dispensing object.

Example 5

Standard Calibration Procedure

In some embodiments, the instant invention can utilize a calibration algorithm that can allow to determine physical parameters of the passive roller's (e.g., idle roller (105, 205, 305)) perimeter (e.g., total run-out, exact perimeter, etc.), and, by utilizing the stored perimeter characteristic(s) of the passive roller (e.g., idle roller (105, 205, 305)) to minimize or eliminate errors. In some embodiments, total run-out variations (e.g., a radius irregularity—i.e., rollers having a circumference which is not a perfect circle) are not accumulated over rotation. In some embodiments, as the instant invention computes an average passive roller perimeter, the error can be determined as a variation between a mean perimeter and an actual variance at a particular point on one partial rotation.

In some embodiments, the instant invention can utilize a standard calibration that can compensate for one or more factors of the dispensing system except for the sensor's own non-linearities. In some embodiments, the instant invention can utilize an extended calibration that can compensate for one or more factors of the dispensing system and the sensor's own non-linearities.

In some embodiments, the instant invention can utilize the standard calibration to enhance the sensor accuracy inside the system and achieve improved results (e.g, smaller reading errors). In some embodiments, the system accuracy depends from one or more of the following factors, but not limited to: the displacement measuring sensor's accuracy, the mounting, the dispensing object (e.g., strip of tickets), alignment, a size of the passive roller (e.g., idle roller (105, 205, 305)), and other mechanical factors. In some embodiments, the standard calibration procedure can compensate for most of the factors to optimize performance of a particular dispensing system.

Figure 4:
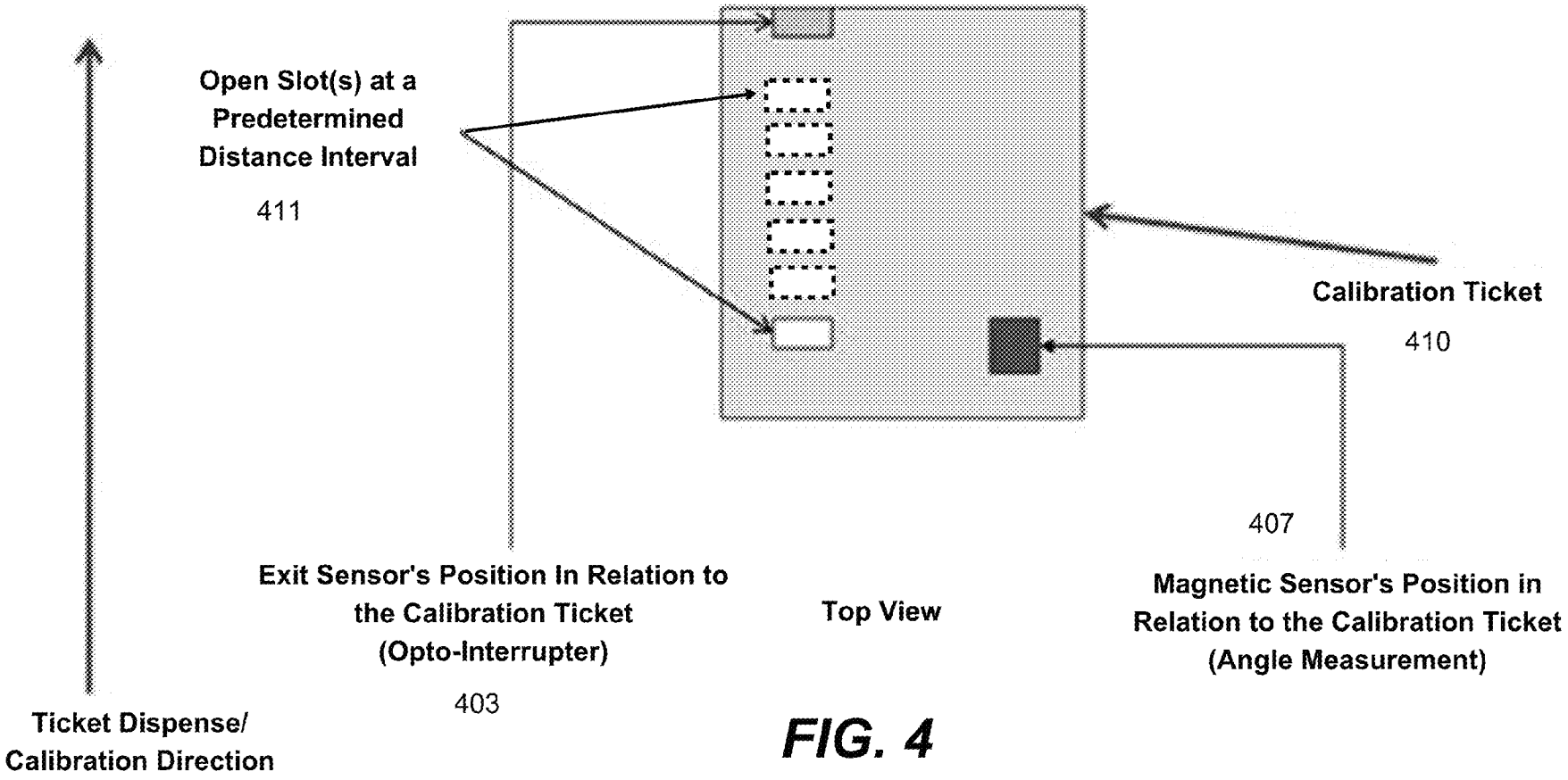
FIG. 4 illustrates further inventive aspects of some embodiments of the instant invention.

In some embodiments, as shown in FIG. 4, the standard calibration is accomplished as follows. In some embodiments, when, for example, the inventive dispenser of the instant invention dispenses a strip of tickets, the instant invention utilizes a special calibration ticket (410) that can have one or more slots (e.g., 411) at predetermined distance intervals. The calibration slot(s) is/are located in such manner that the slot(s) pass(es) over the exit sensor (e.g., sensor 403). In some embodiments, since the displacement measurement sensor (e.g., the sensor 407) is not aligned with the exit sensor, the slot(s) do(es) not affect the measured distance.

In some embodiments, as the calibration ticket (410) passes above the exit sensor and the forward edge of a first slot passes over it, the instant invention can reset or register the distance/displacement measurement and begin to count a distance. In some embodiments, when the last slot (e.g., slot 411) passes over the exit sensor (403), the instant invention gathers the measured value from the distance/displacement measuring sensor (407).

In some embodiments, the difference between these two values provides a calibration value that correlates counts from the angle sensor with the actual distance travelled by the calibration ticket. In some embodiments, the distance between the first and the last slots of the calibration ticket (410) is at least 254 mm (10 inch) to sufficiently improve the calibration's accuracy.

Figure 5:
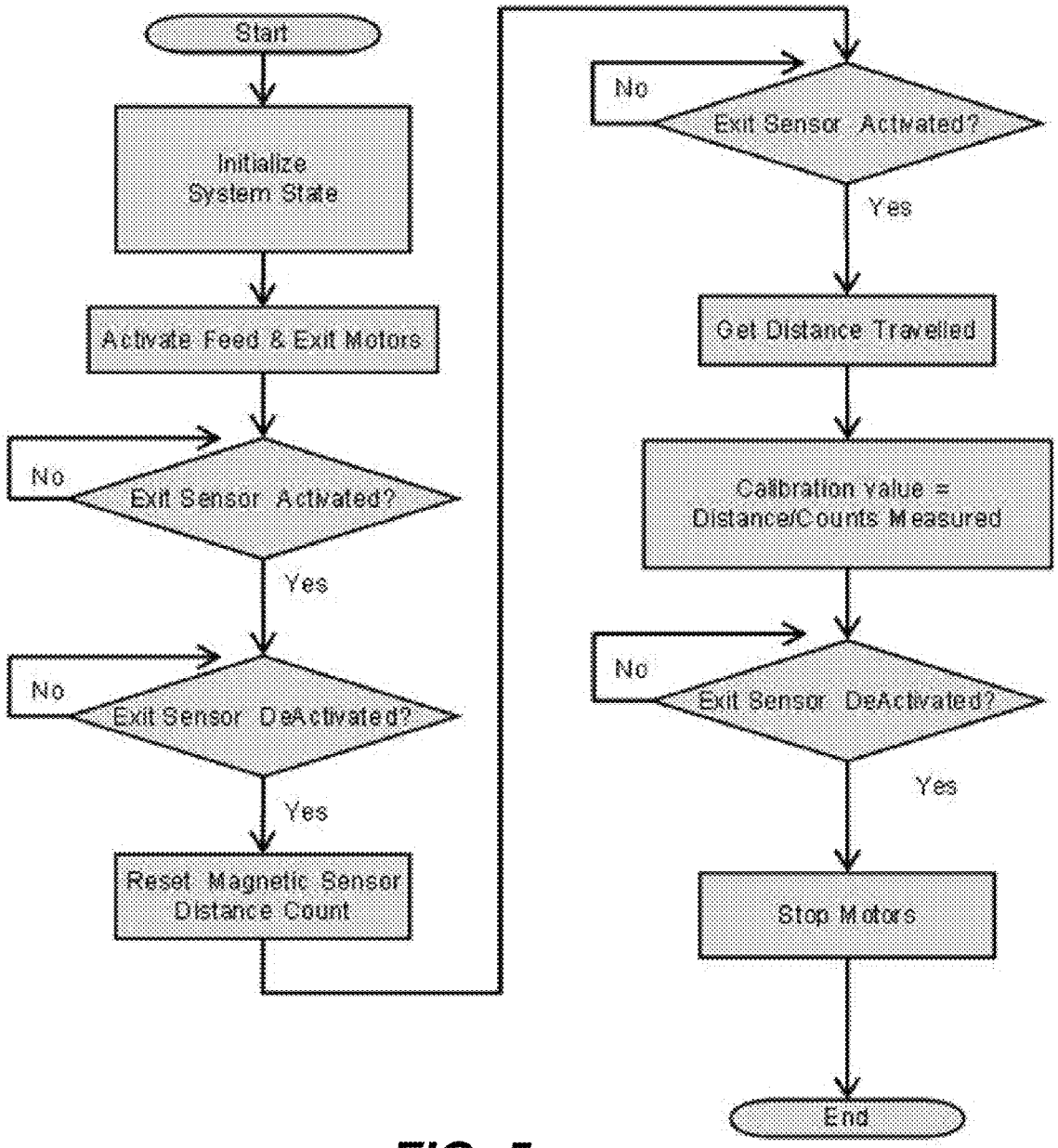
FIG. 5 illustrates yet further inventive aspects of some embodiments of the instant invention.

In some embodiments, the standard calibration can be conducted in accordance with an exemplary process flow shown in FIG. 5, where:

the term "Feed & Exit Motors" references the exemplary feed roller assembly (101) and the exemplary exit roller assembly (102);

the term "Exit Sensor" references the exemplary exit sensor (103); and the term "Magnetic Sensor" references the exemplary displacement measuring sensor (107).

Example 6

Extended Calibration Procedure

In some embodiments, the extended calibration can be performed to enhance the sensor's linearity and a micro-positioning control by additionally minimizing or eliminating non-uniformity errors of the passive roller's circumference.

Figure 6:
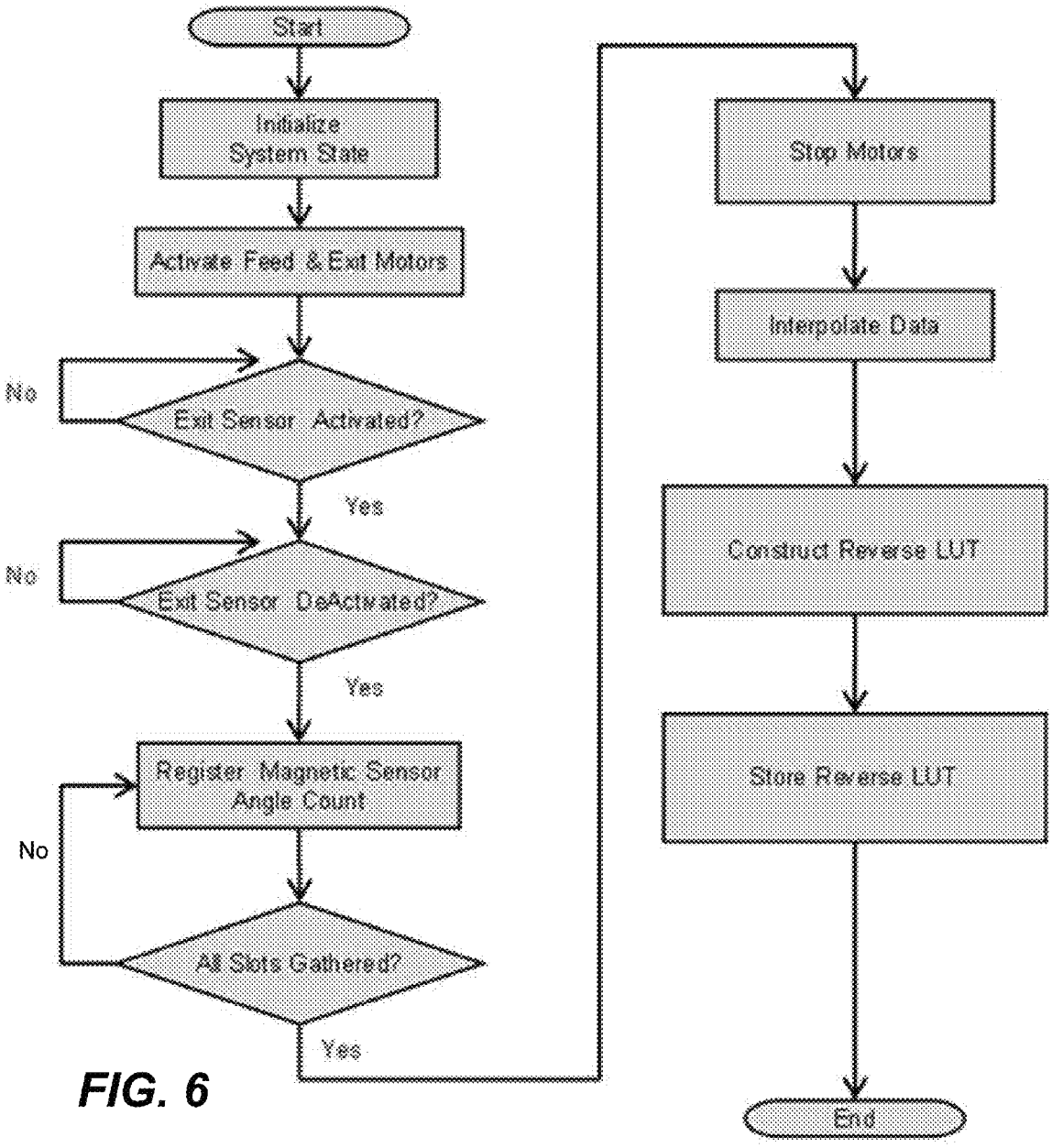
FIG. 6 illustrates additional inventive aspects of some embodiments of the instant invention.

In some embodiments, the extended calibration can be accomplished as, for example, shown in FIG. 6, where:

the term "Feed & Exit Motors" references the exemplary feed roller assembly (101) and the exemplary exit roller assembly (102);

the term "Exit Sensor" references the exemplary exit sensor (103);

the term "Magnetic Sensor" references the exemplary displacement measuring sensor (107); and the term "Slots" references cutouts in a calibration dispensing object (e.g., calibration ticket 410) similar to the exemplary slot(s) (411).

In some embodiments, the instant invention can utilize a special calibration object (e.g., the calibration ticket 410) that has slots (e.g., slots 411) at predetermined distance intervals. For example, in some embodiments, the special calibration ticket can have about 10-30 slots per the passive roller's diameter (e.g., per 2.6 inch). In some embodiments, the slots are located in such manner as to pass over the exit sensor (e.g., sensor 103, 403). In some embodiments, since the displacement sensor (e.g., sensor 107, 407) is not aligned with the exit sensor (e.g., sensor 103, 403), the slots (e.g., slots 411) do not affect the measured distance.

In some embodiments, as the calibration ticket (e.g., ticket 410) passes above the exit sensor (e.g., sensor 103, 403) and the forward edge of a first slot passes over the exit sensor (e.g., sensor 103, 403), the displacement sensor (e.g., sensor 107, 407) of the instant invention starts to register the angle sensor measurement. In some embodiments, on each slot interruption received from the exit sensor (e.g., sensor 103, 403), the displacement sensor (e.g., sensor 107, 407) of the instant invention continues to register the raw angle measurements. In some embodiments, after the entire calibration ticket passes, the displacement sensor (e.g., sensor 107, 407) of the instant invention correlates the raw angle measurements collected for one full rotation of the idle roller (e.g., rollers (105, 205, and 305)) with data collected from using the slots (e.g., 411) of the calibration tickets. In some embodiments, the instant invention allows to estimate the actual angle from the equation (3).

$$\text{ActualAngleCount} = (\text{SlotNumber} * \text{MaxAngleCountsPerRotation}) / \text{SlotsPerRotation} \quad (3)$$

Figure 7:
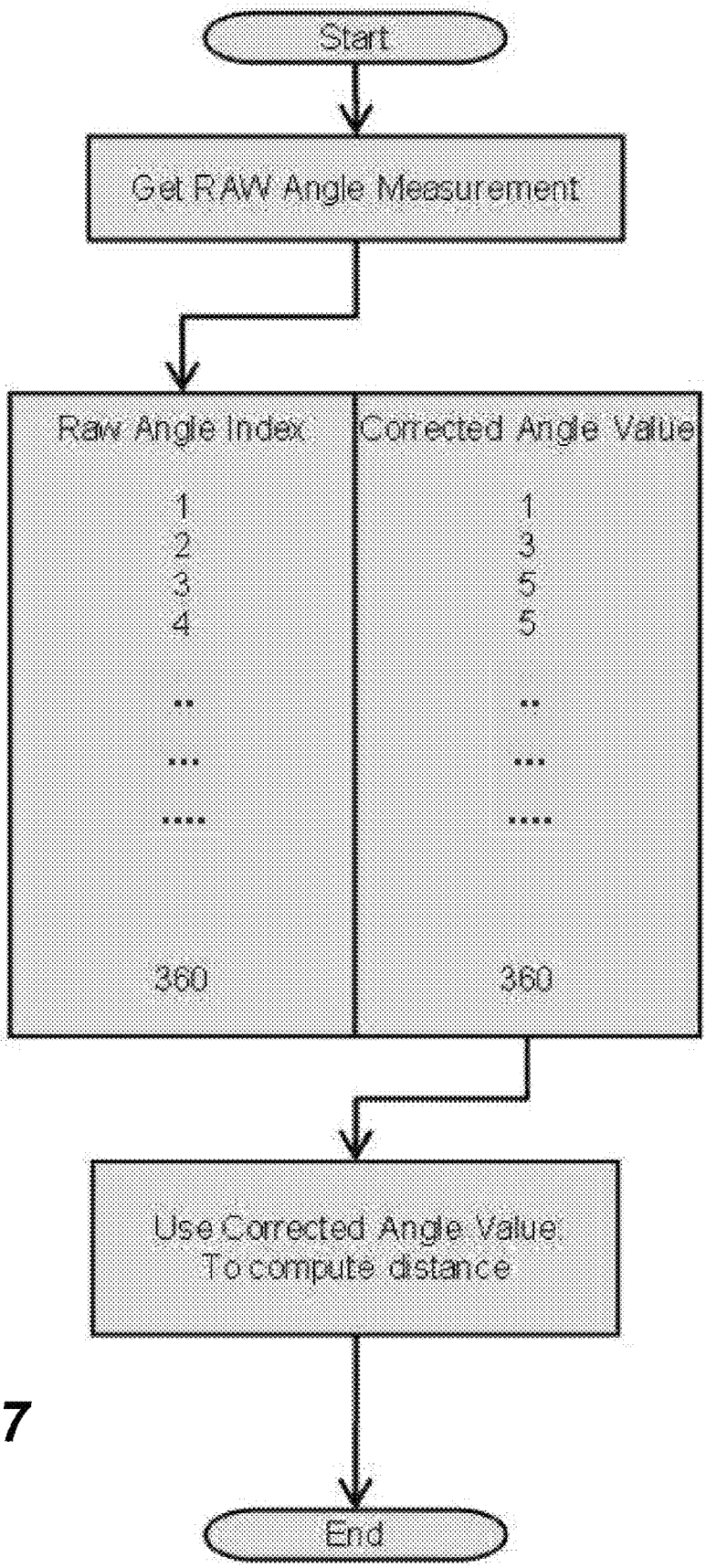
FIG. 7 illustrates further additional inventive aspects of some embodiments of the instant invention.

In some embodiments, in accordance with the instant invention, each registered measurement is assigned to the slot distance and interpolated to obtain the intermediate counts to construct a reverse look-up table that can be used to linearize the distance/displacement measuring sensor, as shown in FIG. 7.

Example 7

Feed Sensor Assembly

In some embodiments, the instant invention allows to avoid incorporating into the motor block any measuring device (unless it is needed for diagnostic purposes). In some embodiments, the instant invention allows to provide the feed drive assembly that minimizes or eliminates redundant components and/or orientations which would otherwise can be needed for sensor mountings and operation if the displacement sensor is associated with the feed drive assembly. In some embodiments, the instant invention allows to utilize a basic worm gear arrangement to reduce size and cost of the feed drive assembly. In some embodiments, the instant invention allows to utilize a multi-channel design extended to accommodate more dispensers in parallel.

Example 8

The Passive Measurement Roller

In some embodiments, one or more of the passive measurement rollers can be, but not limited to, one or more of the following variations:

1) independent roller;
2) idle feed roller;
3) idle feed roller with the pressure/contact retainer mechanism;
4) idle exit roller; and
5) idle exit roller with the pressure/contact retainer mechanism.

Example 9

The Measuring Sensors

In some embodiments, one or more of the measuring sensors can be, but not limited to, one or more of the following variations:

Optic sensors;

Magnetic sensors that utilize disk, ring, two-pole, multi-pole, or any other suitable magnets or magnetic-type devices;

Other suitable commercial-off-the-shelf encoder(s) that provide(s) a quadrature to determine a direction; and Other suitable rotational measurement devices.

In some embodiments, the instant invention provides an exemplary method for dispensing that at least includes: a) initiating a movement of a dispensing object along a dispensing passage of a dispensing device, where the movement is initiated from a pre-set starting position; b) determining, by at least one displacement sensor, a magnitude of a displacement of the dispensing object along the dispensing passage based on remotely measuring, by the at least one displacement sensor, at least one characteristic associated with the dispensing object during the movement of the dispensing object along the dispensing passage; c) generating at least one first indication by the at least one displacement sensor when the magnitude of the displacement is equal to or exceeds a predetermined distance value; d) separating, based on the at least one first indication, a portion from the dispensing object to form a remaining portion of the dispensing object and a separated portion of the dispensing object, e) moving the remaining portion of the dispensing object back to the pre-set starting position; and f) dispensing the separated portion of the dispensing object from the dispensing device.

In some embodiments, the exemplary method of the instant invention further includes: generating, by at least one exit sensor positioned next to an exit end of the dispensing passage of the dispensing device, at least one second indication when the dispensing object reaches the at least one exit sensor, where the determining, by the at least one displacement sensor, of the magnitude of the displacement of the dispensing object along the dispensing passage begins after the at least one displacement sensor receives the at least one second indication.

In some embodiments, the at least one characteristic associated with the dispensing object is determined based, at least in part, on: registering, by the at least one displacement sensor, at least one angle of displacement of at least one magnet attached to an idle roller which is rotated by a surface of the dispensing object during the movement of the dispensing object along the dispensing passage.

In some embodiments, the at least one characteristic associated with the dispensing object is determined based, at least in part, on at least one light characteristic registered by the at least one displacement sensor after at least one light beam is directed at a surface of the dispensing object during the movement of the dispensing object along the dispensing passage.

In some embodiments, the exemplary method of the instant invention further includes: maintaining, by at least one tension mechanism, the dispensing object in a state of tension and at a pre-determined separation distance away from the at least one displacement sensor. In some embodiments, the at least one tension mechanism comprises at least one active roller.

In some embodiments, the at least one tension mechanism further includes a plurality of active rollers, where the plurality of active rollers comprises at least one feeding roller rotating at a first speed and at least one exit roller rotating at a second speed, and where the first and the second speeds are different.

In some embodiments, the dispensing object is a strip of lottery tickets and the separated portion of the dispensing object is a lottery ticket.

In some embodiments, the instant invention provides a dispensing device that at least includes: a) at least one active feed mechanism to initiate a movement of a dispensing object along a dispensing passage of a dispensing device, where the movement is initiated from a pre-set starting position; b) at least one displacement sensor, i) where the at least one displacement sensor determines a magnitude of a displacement of the dispensing object along the dispensing passage based on remotely measuring at least one characteristic associated with the dispensing object during the movement of the dispensing object along the dispensing passage, and ii) where the at least one displacement sensor generates at least one first indication when the magnitude of the displacement is equal to or exceeds a pre-determined distance value; c) at least one separation mechanism, where the at least one separation mechanism separates, based on the at least one first indication, a portion from the dispensing object to form a remaining portion of the dispensing object and a separated portion of the dispensing object, d) where the at least one active feed mechanism moves the remaining portion of the dispensing object back to the pre-set starting position; and e) where the at least one active feed mechanism dispenses the separated portion of the dispensing object from the dispensing device.

In some embodiments, the instant invention provides an exemplary method for dispensing that at least includes: a) initiating a movement of a dispensing object along a dispensing passage of a dispensing device, i) where the movement is initiated from a pre-set starting position; b) rotating at least one passive wheel as a result of only the movement of the dispensing object as the at least one passive wheel continuously contacts the dispensing object when the dispensing object moves along the dispensing passage of the dispensing device; c) remotely measuring, by at least one displacement sensor, a contact surface of the at least one passive wheel, where the contact surface of the at least one passive wheel is a surface of the at least one passive wheel that has touched the dispensing object as the dispensing object moves along the dispensing passage of the dispensing device; d) determining a magnitude of a displacement of the dispensing object based, at least in part, on the contact surface of the at least one passive wheel; e) generating at least one first indication by the at least one displacement sensor when the magnitude of the displacement is equal to or exceeds a pre-determined value; f) separating, based on the at least one first indication, a portion from the dispensing object to form a remaining portion of the dispensing object and a separated portion of the dispensing object; g) moving the remaining portion of the dispensing object back to the pre-set starting position; and h) dispensing the separated portion of the dispensing object from the dispensing device.

In some embodiments, the exemplary method of the instant invention further includes: generating, by at least one exit sensor positioned next to an exit end of the dispensing passage of the dispensing device, at least one second indication when the dispensing object reaches the at least one exit sensor, where, after the at least one displacement sensor receives the at least one second indication, the measuring, by the at least one displacement sensor, of the contact surface of the at least one passive wheel begins.

In some embodiments, the at least one displacement sensor measures a magnitude of the contact surface of the at least one passive wheel based, at least in part, on at least one rotational characteristic associated with the rotation of the at least one passive wheel.

In some embodiments, the at least one rotational characteristic is determined based, at least in part, on at least one light characteristic associated with the at least one passive wheel where the at least one light characteristic is registered by the at least one displacement sensor after at least one light beam is directed at the surface of the at least one passive wheel.

In some embodiments, the contact surface of the at least one passive wheel is remotely measured based, at least in part, on at least one light characteristic associated with the contact surface of the at least one passive wheel where the at least one light characteristic is registered by the at least one displacement sensor after at least one light beam is directed at the contact surface of the at least one passive wheel.

In some embodiments, the exemplary method of the instant invention further includes: maintaining, by at least one tension mechanism, the dispensing object in a pre-determined state of tension so that the at least one passive wheel continuously contacts the dispensing object when the dispensing object moves along the dispensing passage of the dispensing device.

In some embodiments, the instant invention provides an exemplary dispensing device that at least includes: a) at least one active feed mechanism to initiate a movement of a dispensing object along a dispensing passage of the dispensing device, i) where the movement is initiated from a pre-set starting position; b) at least one passive wheel that rotates as a result of only the movement of the dispensing object as the at least one passive wheel continuously contacts the dispensing object when the dispensing object moves along the dispensing passage of the dispensing device; c) at least one displacement sensor to remotely measure a contact surface of the at least one passive wheel, where the contact surface of the at least one passive wheel is a surface of the at least one passive wheel that has touched the dispensing object as the dispensing object moves along the dispensing passage of the dispensing device; d) where a magnitude of a displacement of the dispensing object is determined based, at least in part, on the contact surface of the at least one passive wheel; e) where the at least one displacement sensor generates at least one first indication when the magnitude of the displacement is equal to or exceeds a pre-determined value; f) at least one separating mechanism to separate, based on the at least one first indication, a portion from the dispensing object to form a remaining portion of the dispensing object and a separated portion of the dispensing object; g) where the at least one feed mechanism moves the remaining portion of the dispensing object back to the pre-set starting position; and h) where the at least one feed mechanism dispenses the separated portion of the dispensing object from the dispensing device.

In some embodiments, the instant invention can provide for a method of dispensing a selected number of tickets perforated at intervals in a continuous strip, having at least the steps of: providing a feed roller assembly to drive the strip tickets to the bursting line; providing a sensor displacement measuring assembly that detects ticket positioning; providing a bursting blade that breaks the perforation sideways when ticket is properly positioned; providing an exit rollers assembly to eject the separated ticket out of a dispensing mechanism; and providing a calibration algorithm to minimize systemic positioning errors.

In some embodiments, the instant invention can provide one or more free passive rollers having a sufficient friction and being in a continuous contact with the dispensing ticket. In some embodiments, as the ticket is moving through the dispensing mechanism due to the movement(s) of the feed and/or exit rollers, the free passive roller is pulled by the friction between the free passive roller and the ticket, resulting in the rotational motion of the free passive roller. In some embodiments, one or more magnets are/is attached to the free passive roller (or to its shaft, depending on particular embodiment) and rotate(s) with the free passive roller. In some embodiments, a magnetic sensor is positioned in a suitable proximity to the magnet(s) and measures the magnetic field rotation, outputting, through its interface, the angular positioning of the free passive roller. In some embodiments, one or more microcontroller (programmed computer processor) determines the actual distance traveled by the ticket from the sensor's angular measurement. In some embodiments, top or bottom side of the ticket can be utilized for the measurement.

In some embodiments, the magnet and the sensor can be utilized to provide an absolute angular measurement. For example, at the beginning of the dispensing process, the instant invention can allow to determine the free passive roller's exact (present—i.e., at time (0)) angular position.

In some embodiments, the magnet and the sensor can be utilized to provide a relative measurement. For example, the instant invention can utilize a multi-pole (e.g., 4-pole) magnet to, at the beginning of the dispensing process, to determine relative measurements of the angular rotation from a "virtual" or preset zero position. without, first, determining the free passive roller's exact angular position.

In some embodiments, the instant invention can measure the displacement of the dispensing object (e.g., a strip of tickets), by utilizing either a top, a bottom or both sides of the dispensing object (e.g., a strip of tickets). In some embodiments, the instant invention can utilize a pressure mechanism (e.g., spring, sheet metal, etc) to retain the free passive/idle roller in contact with the dispensing object (e.g., a strip of tickets) during the dispensing.

In some embodiments, the instant invention can allow for the sensor assembly to detect the presence of dispensing object In some embodiments, for example, when a ticket is inserted to the free passive roller of the sensor (which is positioned before the feed rollers), the rotation of the passive roller is detected that is not caused by the dispensing mechanism itself and the instant invention can generate an output determining that a ticket should be loaded by the dispensing mechanism: i.e., activating the feed and/or exit rollers.

While a number of embodiments of the present invention have been described, it is understood that these embodiments are illustrative only, and not restrictive, and that many modifications may become apparent to those of ordinary skill in the art. Further, any steps described herein may be carried out in any desired order (and any steps may be added and/or deleted).

What is claimed is:

1. A method for dispensing, comprising:

a) initiating a movement of a dispensing object along a dispensing passage of a dispensing device, wherein the movement is initiated from a pre-set starting position;

b) determining, by at least one displacement sensor, a magnitude of a displacement of the dispensing object along the dispensing passage based on remotely measuring, by the at least one displacement sensor, at least one characteristic associated with the dispensing object during the movement of the dispensing object along the dispensing passage;

wherein the at least one characteristic associated with the dispensing object is determined based, at least in part, on:

registering, by the at least one displacement sensor, at least one angle of displacement of at least one magnet attached to an idle roller which is rotated by a surface of the dispensing object during the movement of the dispensing object along the dispensing passage;

c) generating at least one first indication by the at least one displacement sensor when the magnitude of the displacement is equal to or exceeds a pre-determined distance value;

d) separating, based on the at least one first indication, a portion from the dispensing object to form a remaining portion of the dispensing object and a separated portion of the dispensing object, e) moving the remaining portion of the dispensing object back to the pre-set starting position; and f) dispensing the separated portion of the dispensing object from the dispensing device.

2. The method of claim 1, wherein the method further comprises:

generating, by at least one exit sensor positioned next to an exit end of the dispensing passage of the dispensing device, at least one second indication when the dispensing object reaches the at least one exit sensor, wherein the determining, by the at least one displacement sensor, of the magnitude of the displacement of the dispensing object along the dispensing passage begins after the at least one displacement sensor receives the at least one second indication.

3. The method of claim 1, wherein the at least one characteristic associated with the dispensing object is determined based, at least in part, on at least one light characteristic registered by the at least one displacement sensor after at least one light beam is directed at a surface of the dispensing object during the movement of the dispensing object along the dispensing passage.

4. The method of claim 1, wherein the method further comprises:

maintaining, by at least one tension mechanism, the dispensing object in a state of tension and at a pre-determined separation distance away from the at least one displacement sensor.

5. The method of claim 4, wherein the at least one tension mechanism comprises at least one active roller.

6. The method of claim 4, wherein the at least one tension mechanism further comprises a plurality of active rollers, wherein the plurality of active rollers comprises at least one feeding roller rotating at a first speed and at least one exit roller rotating at a second speed, and wherein the first and the second speeds are different.

7. The method of claim 1, wherein the dispensing object is a strip of lottery tickets and wherein the separated portion of the dispensing object is a lottery ticket.

8. A dispensing device, wherein the dispensing device comprises:

a) at least one active feed mechanism to initiate a movement of a dispensing object along a dispensing passage of the dispensing device, wherein the movement is initiated from a pre-set starting position;

b) at least one displacement sensor, i) wherein the at least one displacement sensor determines a magnitude of a displacement of the dispensing object along the dispensing passage based on remotely measuring at least one characteristic associated with the dispensing object during the movement of the dispensing object along the dispensing passage, ii) wherein the at least one displacement sensor generates at least one first indication when the magnitude of the displacement is equal to or exceeds a pre-determined distance value; and wherein the at least one displacement sensor registers at least one angle of displacement of at least one magnet attached to an idle roller, which is rotated by a surface of the dispensing object during the movement of the dispensing object along the dispensing passage, so as to determine the at least one characteristic associated with the dispensing object;

c) at least one separation mechanism, wherein the at least one separation mechanism separates, based on the at least one first indication, a portion from the dispensing object to form a remaining portion of the dispensing object and a separated portion of the dispensing object, d) wherein the at least one active feed mechanism moves the remaining portion of the dispensing object back to the pre-set starting position; and e) wherein the at least one active feed mechanism dispenses the separated portion of the dispensing object from the dispensing device.

9. The dispensing device of claim 8, wherein the dispensing device further comprises:

at least one exit sensor, wherein the at least one exit sensor is positioned next to an exit end of the dispensing passage of the dispensing device and generates at least one second indication when the dispensing object reaches the at least one exit sensor; and wherein the at least one displacement sensor determines the magnitude of the displacement of the dispensing object along the dispensing passage after the at least one displacement sensor receives the at least one second indication.

10. The dispensing device of claim 8, wherein the at least one displacement sensor registers at least one light characteristic, after at least one light beam is directed at a surface of the dispensing object during the movement of the dispensing object along the dispensing passage, to determine the at least one characteristic associated with the dispensing object.

11. The dispensing device of claim 8, wherein the dispensing device further comprises at least one tension mechanism, wherein the at least one tension mechanism maintains the dispensing object in a state of tension and at a pre-determined separation distance away from the at least one displacement sensor.

12. The dispensing device of claim 11, wherein the at least one tension mechanism comprises at least one active roller.

13. The dispensing device of claim 11, wherein the at least one tension mechanism further comprises a plurality of active rollers, wherein the plurality of active rollers comprises at least one feeding roller rotating at a first speed and at least one exit roller rotating at a second speed, and wherein the first and the second speeds are different.

14. The dispensing device of claim 8, wherein the dispensing object is a strip of lottery tickets and wherein the separated portion of the dispensing object is a lottery ticket.

* * * * *